United States Patent [19]

Crump et al.

[11] 4,050,569

[45] Sept. 27, 1977

[54] RECORD MEDIA ADVANCING MECHANISM

[75] Inventors: Leslie L. Crump; Victor J. Italiano, both of Trumansburg, N.Y.

[73] Assignee: NCR Corporation, Dayton, Ohio

[21] Appl. No.: 693,033

[22] Filed: June 4, 1976

[51] Int. Cl.[2] ..... B41J 19/90

[52] U.S. Cl. ..... 197/120; 197/1 R; 197/82; 197/114 R; 197/127 R; 197/133 R; 197/133 R

[58] Field of Search ..... 197/1 R, 114 R, 114 A, 197/114 B, 120, 121, 122, 123, 127 R, 129, 133 R, 186 R, 186 A, 186 B; 226/54, 67

[56] References Cited

U.S. PATENT DOCUMENTS

| | | | |
|---|---|---|---|
| 830,115 | 9/1906 | Turner | 197/120 X |
| 873,304 | 12/1907 | Du Belle | 197/120 X |
| 1,116,212 | 11/1914 | Beard | 197/127 R |
| 2,543,919 | 3/1951 | Mabon et al. | 197/133 R |
| 2,578,771 | 12/1951 | Zint | 197/120 X |
| 2,895,585 | 7/1959 | Guldner et al. | 197/114 R |
| 2,917,153 | 12/1959 | Westover | 197/133 R |
| 3,272,303 | 9/1966 | Pohl | 197/127 R X |
| 3,444,977 | 5/1969 | Kinney et al. | 197/129 |
| 3,477,627 | 11/1969 | Webers | 226/54 |
| 3,572,567 | 3/1971 | Claar | 226/67 |
| 3,653,483 | 4/1972 | Cortona et al. | 197/129 |
| 3,750,792 | 8/1973 | Liles | 197/1 R |

*Primary Examiner*—Ernest T. Wright, Jr.
*Attorney, Agent, or Firm*—J. T. Cavender; Wilbert Hawk, Jr.; George J. Muckenthaler

[57] ABSTRACT

The print head carriage for a printer has end-mounted toothed clutches secured thereto and engageable with mating toothed clutches mounted on the carriage support shaft for rotation thereof upon near end of travel of the carriage across the printer. The teeth of the carriage mounted clutches are one-half pitch length out of phase with the teeth of the mating clutches so that, at each end of carriage travel, the mating clutches are caused to be incrementally rotated to thereby rotate the carriage support shaft and the record media drive shaft for advancing the record media a predetermined distance.

17 Claims, 5 Drawing Figures

RECORD MEDIA ADVANCING MECHANISM

BACKGROUND OF THE INVENTION

In the area of record media advancement in business machines, it has long been common practice to use drive rollers, drive belts, sprocket wheels, cam and follower devices, clutch mechanisms, and related apparatus for causing the record media to be driven or advanced past a reading or recording station with expected preciseness and certainty of operation so that the lines of indicia are exact and compatible with the reading or recording operation. For example, a standard spacing in printed matter is set at six lines per inch and the record media is expected to be advanced by mechanism which provides for incremental driving of the media to obtain the desired line spacing.

While many ways and means of line spacing have been disclosed, representative prior art may include U.S. Pat. No. 2,895,585, issued to H. Guldner et al. and relating to line spacing devices for business machines wherein a ratchet wheel, a control lever, a cam and drive element operate the device by pivotal movement of the drive element during transverse movement of the carriage, there being pawls operating with the ratchet wheel for forward or reverse line spacing. U.S. Pat. No. 3,444,977, issued to M. E. Kinney et al., shows mode selection for the control of a plurality of work sheets in a billing machine wherein a manual lever operates with a releasable clutch connection through a rocker member and a claw to advance the forms. U.S. Pat. No. 3,477,627, issued to H. Webers, shows synchronized reciprocating feed devices wherein first and second rotary-to-oscillating motion conversion devices, together with first and second feed pawls, operate to feed workpieces in long and short strokes in one direction.

U.S. Pat. No. 3,572,567, issued to H. Claar, discloses cam mechanism for the film-advancing system in a cinematographic device wherein a cam of disc members, defining cam surfaces which are out of phase with each other, operate with cam followers for converting motion of the drive shaft into reciprocating motion of the film pull down claw. And, U.S. Pat. No. 3,653,483, issued to A. Cortona et al., discloses a paper feed system for accounting machines having platens rotatable independently of one another and including feeding of the journal sheet by use of an actuating magnet, a presetting magnet, an actuating clutch and various presetting clutches.

SUMMARY OF THE INVENTION

The present invention relates to means for advancing record media in incremental manner past a working station. And while the invention may be quite adaptable for record printers of both the impact and non-impact type, it is, of course, contemplated that such invention may also be utilized in various other equipment such as, for example, in indicia reading, punching, erasing, and the like.

For purposes of the present disclosure, the invention is herein associated with a printing mechanism including a rotating drum cam arranged to drive a print head carriage, slidably mounted on a support shaft, in a bidirectional linear path back and forth across a printing area or station, the printing being performed by driving a plurality of print wires, which are contained in print heads, into contact with the record media in matrix printing manner. Since the printing is accomplished by the forming of a line of dots for each pass of the print heads, the record media advancing mechanism is expected to advance the media in small incremental distances corresponding to the distance between each line of printed dots. A line of dots is printed, in the formation of the printed characters, as the print head and its carriage, slidably carried by such support shaft, is caused to be traversed in each direction, the record media being advanced by drive mechanism as the carriage nears its end of travel in each direction.

A radially-arranged toothed clutch is mounted on and secured to the print head carriage on each side thereof to provide the driving force for like radially-arranged toothed clutches which are mounted on and secured to the print head carriage support shaft for rotation therewith, the support shaft being journaled in the side walls of the machine frame. A gear secured to one end of the support shaft meshes with a gear on one end of the record media drive shaft to rotate the drive shaft and thereby advance the record media past the printing station. By reason of a toothed clutch being affixed to each side of the print head carriage and mating with a respective toothed clutch on the ends of the support shaft at each side of the printer, but one-half pitch length out of phase from each other, the record media is caused to be advanced through rotation of the support shaft at the end of travel of the print head carriage for each traversal thereof.

In view of the above discussion, the principle object of the present invention is to provide means for advancing record media in precise manner.

Another object of the present invention is to provide means for advancing record material at the end of each traversal of the printing mechanism.

An additional object of the present invention is to provide means for advancing record media in incremental manner past the printing station.

A further object of the present invention is to provide clutch members on the print head carriage engageable with mating clutch members on the machine for advancing the record media past the printing station.

Additional advantages and features of the present invention will become apparent and fully understood from a reading of the following description taken together with the annexed drawing, in which.

Figure 1:
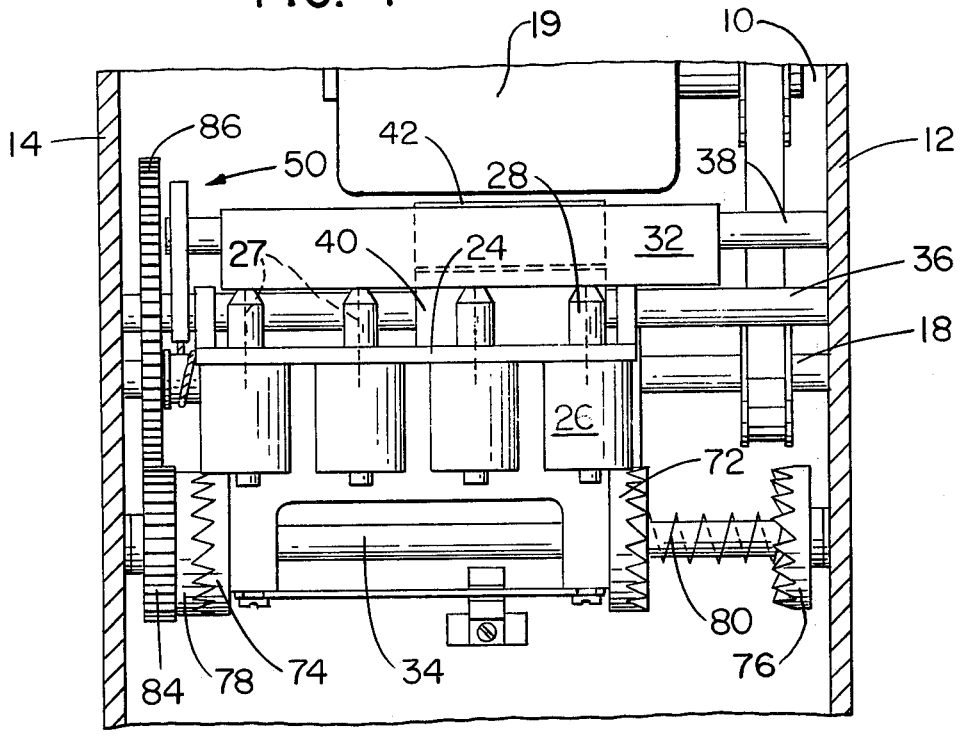
FIG. 1 is a plan view of a portion of a printer incorporating the subject matter of the present invention.
Figure 2:
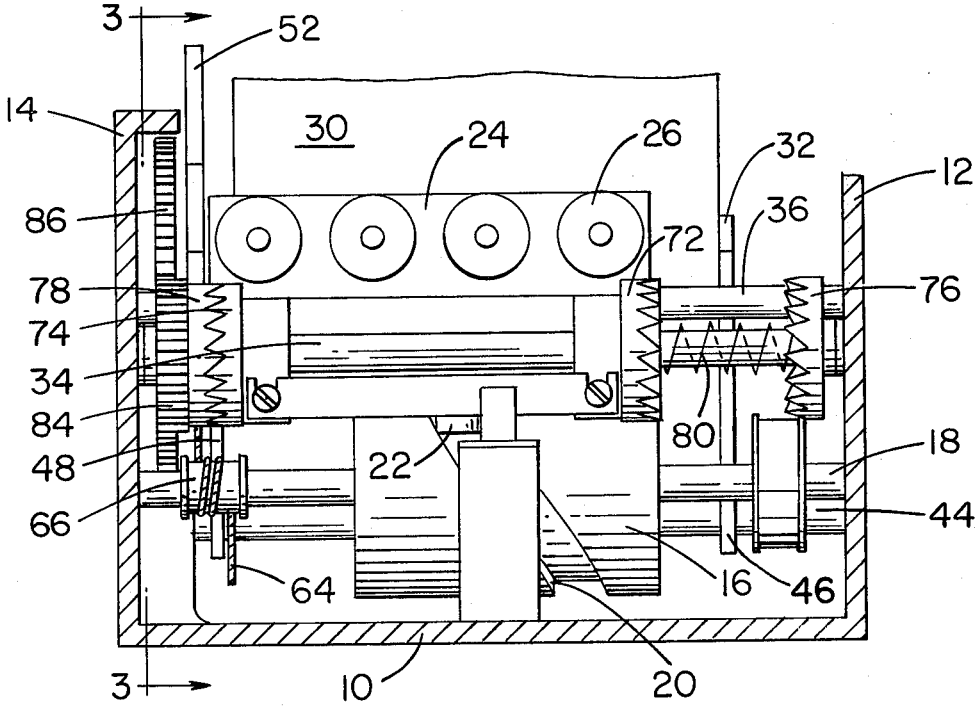
FIG. 2 is a front elevational view of the printer shown in FIG. 1.

Referring now to the drawing, FIGS. 1 and 2 show, in plan and in front elevational views, a portion of a printer having a base 10 and side frames 12 and 14 for supporting various machine parts and for journaling of shafts utilized in driving operating members of the machine. A drum type cam 16 is carried on a shaft 18 and rotatably driven by a motor 19, the cam 16 having a groove 20 around the circumference thereof for reception of and for guiding a cam follower 22 secured to a print head carriage 24 (see also FIGS. 3 and 4). A plurality of solenoids 26 are secured to the carriage 24, each of such solenoids 26 being positioned for driving a print wire 27 of a print head 28 against record media 30 which is caused to be driven in a path between the ends of the print heads 28 and a platen 32 supported in appropriate manner rearward of the print heads 28. The solenoids 26 are energized by suitable means to drive the respective print wires 27 against the record media 30 for printing marks or dots thereon. In the present machine, the printing is performed in serial manner whereby a line of dots is printed upon traversal of the carriage 24 each and every time it is caused to be driven back and forth across the machine.

Figure 3:
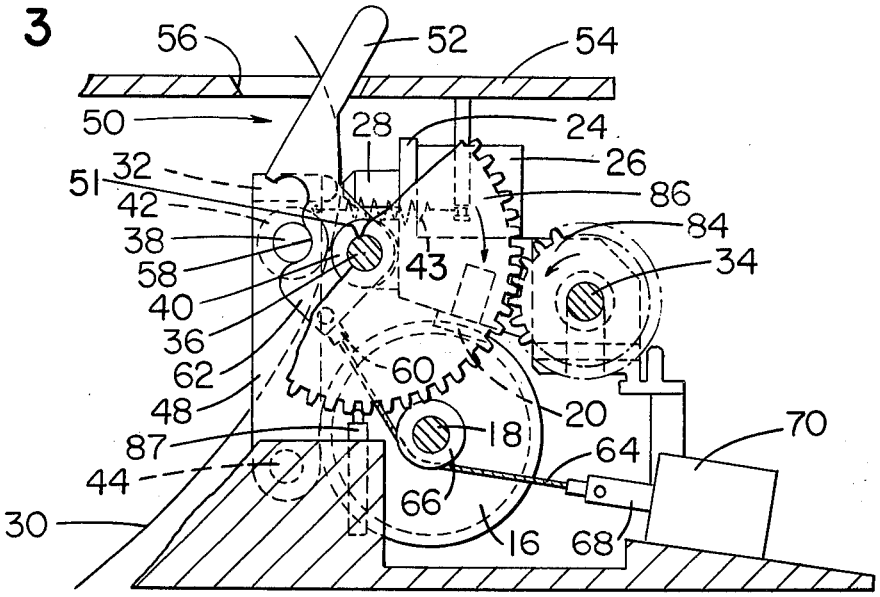
FIG. 3 is a view taken on the plane 3—3 of FIG. 2.
Figure 4:
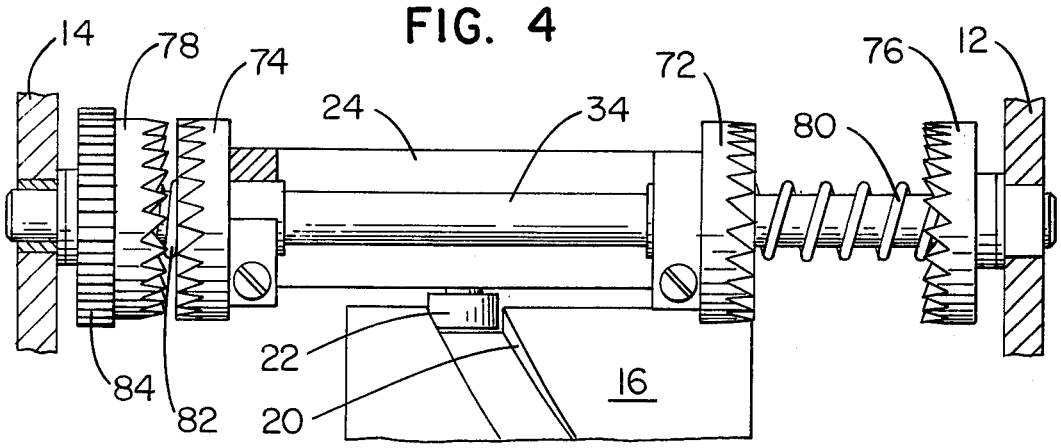
FIG. 4 is an enlarged view of a portion of the record media drive mechanism shown in FIG. 2.

As best understood from FIGS. 2 and 4, the print head carriage 24 is slidingly supported on a shaft 34 journaled in the side walls 12 and 14, whereby upon rotation of cam member 16 the cam follower 22 operating within groove 20 imparts reciprocating movement of the carriage 24 along such shaft 34. The record media 30 is driven and caused to be directed in an upward path by a drive roller 40 carried by a shaft 36 also journaled in the walls 12 and 14, there being an idler roller 42 on a shaft 38 rearward of the drive shaft 36 and cooperating with such drive roller 40 to maintain a force of several pounds (by appropriate spring means 43) on the record media 30 as it is caused to be driven thereby. A pivot shaft 44 is journaled rearward of the cam shaft 18 (FIGS. 2 and 3) and supports two upstanding arms 46 and 48 secured to the shaft 44, the arms 46 and 48 being also secured to and supporting the platen 32 whereby the platen 32 may be swingable away from the plane of the ends, and hence print wires 27, of the print heads 28. The arms 46 and 48 also provide a journal for the idler roller shaft 38 which is swingable rearwardly (against the force of the spring means 43 mentioned above) and away from the drive roller shaft 36 so as to provide clearance between the drive and idler rollers 40 and 42, respectively, and also between the print heads 28 and the platen 32.

Along with the latter mentioned structure permitting the idler roller shaft 38 to be swingable away from the drive roller shaft 36, a validation cam 50 (FIG. 3) is journaled on the drive roller shaft 36 at the left hand side thereof, the cam 50 having a finger portion 52 extending upwardly above the printer top plate 54 and movable fore and aft in a slot 56 therein. The cam 50 has a cam surface or lobe 58 for engaging with a portion of the circumference of the idler shaft 38 and has a connection 60 on the lower portion 62 of the cam 50 for attaching a cable 64 thereto, the cable 64 being wrapped several turns around a spool 66 secured to the shaft 18 and connected to the armature 68 of a small solenoid 70 secured to the machine. The material makeup of cam 50, which is made of DELRIN or like plastic material, has a low frictional characteristic so that the mounting hole 51 in such cam 50 is an effective bearing for the drive roller shaft 36 as it is rotated with each and every print cycle or line of print. The cam surface or lobe 58 is designed to cam the idler roller shaft 38 to an open or non-cooperating position with respect to the drive roller shaft 36, which is accomplished when solenoid 70 is energized. This, it is clear, permits a check or like document to be manually inserted into the printer between the drive and idler rollers 40, 42 for permitting the usual type validation marking to be made thereon.

The cable 64 is of semi-rigid construction and in the normal printing condition is loosely wound for several turns around the spool 66 on shaft 18. It may also be here noted that the finger portion 52 is accessible to the operator so that hand manipulation of the validation cam 50 can be performed for the validation operation, if so desired.

To overcome the necessity of a large and expensive solenoid to operate the validation cam 50, the present structure provides for the semi-rigid cable 64 to be connected to the validation cam 50, to be coiled about the spool 66 in several turns, and to be connected to the small solenoid 70. Upon energization of the solenoid 70, the plunger 68 is moved to the right in FIG. 3 thereby putting a tension on the cable 64 and tightening the cable loops around the spool 66. The machine motor 19, which drives the cam line shaft 18, is then energized to rotate the drum cam 16 a small amount in the counter-clockwise direction, FIG. 3, whereupon the validation cam 50 is also rotated in the counter-clockwise direction around the drive shaft 36, and whereupon the cam surface 58 of the cam 50 bears against the idler shaft 38 and against the action of springs 43 to move the idler shaft 38 away from the drive shaft 36 and also to move the platen 32 away from the print heads 28 for such insertion of a check or other document into position for validation thereof. After completing the validating operation, the solenoid 70 is de-energized to release tension on the cable 64 and the validation cam 50 is returned to the regular printing mode position along with the platen 32 and the idler shaft 38, together with the arms 46 and 48 secured to the shaft 44, by reason of the spring return. The design of the validation cam 50 permits a small amount of force to keep the idler roller 42 and the drive roller 40 separated or open. The small solenoid 70 provides an approximately 0.4 pound force necessary to maintain separation of these rollers 42, 40 and is based upon 4 pounds force needed by the springs 43 on the idler roller 42 against the drive roller 40 to maintain optimum pressure contact for satisfactory printing and paper advancement. The present design is such that three turns of the cable 64 on the spool 66 provide a mechanical advantage of 10 to 1 and determines the proper size of the small solenoid 70.

Referring now back to the print head carriage 24, which is movable back and forth in reciprocating manner on the shaft 34 and which as best seen in FIG. 4, the carriage 24 has a toothed clutch member 72 secured to the right side thereof and a toothed clutch member 74 secured to the left side thereof. A mating toothed clutch member 76 is secured to the shaft 34 at the right end thereof for engagement by the teeth of member 72 and a like mating toothed clutch member 78 is secured to the shaft 34 at the left end thereof for engagement by the teeth of member 74. Clutch members 72 and 74 are mirror images, as are clutch members 76 and 78, and it being here noted that the carriage-carried members 72 and 74 are aligned for sliding along the shaft 34 and arranged such that the teeth of the one member 72 are one-half pitch length out of phase or displaced from the teeth of the other mirror image member 74. The clutch members 72 and 74, in being secured to the carriage 24, act as linear bearing support for the carriage 24 on the shaft 34. Between members 72 and 76 there is provided on shaft 34 a light compression spring 80 and a similar spring 82 is on the shaft 34 between members 74 and 78, such springs 80, 82 being in contact with the respective clutch members 72, 76, - 74, 78 and acting to cushion the impact of the engaging teeth thereof and of the carriage 24 as it is traversed back and forth along the shaft 34 across the machine.

Toothed member 78 has a drive gear 84 secured thereto which mates with and drives a gear 86 (FIG. 3) secured to the drive roller shaft 36 for driving thereof and causing advancement of the record media 30 each time the carriage 24 is moved in one or the other direction across the machine. A spring-loaded detent 87 is positioned to engage with the teeth of the gear 86 to make certain that the record media 30 is incrementally advanced the same distance past the print heads 28 for each traversal of the carriage 24. Normal direction of rotation of the several gear members 84, 86 is as shown in FIG. 3 wherein gear 84 is driven in the counterclockwise direction by the clutch members 76 and 78, and wherein gear 86 is driven clockwise along with drive roller 40 to advance the record media 30 upwardly past the print heads 28.

Figure 5:
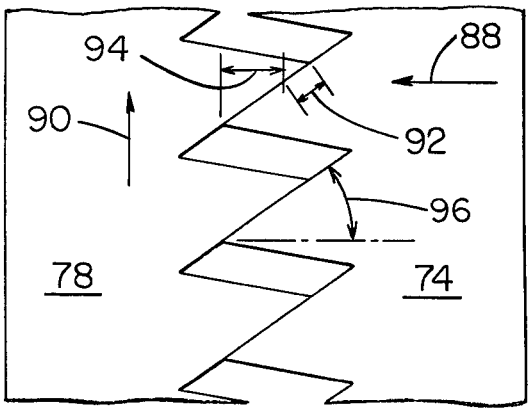
FIG. 5 is an enlarged view showing the position of the teeth of the respective clutches during operation.

In FIG. 5 is shown the contact position of the teeth of clutch member 74 with the teeth of clutch member 78, the member 74 being driven in the direction of the arrow 88 in linear motion and the member 78 being driven in the direction of the arrow 90 in rotary motion. The dimension 92 indicates the area of contact of the teeth of clutch member 74 with the teeth of clutch member 78 at start of engagement when the member 74 is moving from right to left in lateral motion, with the distance of lateral movement, made by the member 74 after the start of engagement position of the teeth of the respective members, being indicated by the dimension 94 to rotate the member 78 an angular distance of 7.5 degrees and thereby through shaft 34 the gear 84 a like angular distance. Such angular movement of gear 84 causes an angular movement of 3.75 degrees of the gear 86 by reason of the gear ratio. Therefore, it is seen that for each right-to-left movement of the print head carriage 24 at a precise time near the end of travel thereof, the gear 86 and the record media drive roller 40 are rotated an incremental distance of 3.75 degrees to advance the record media 30 a distance of 0.015 inch past the platen 32 and the print heads 28 for printing of the next line of dots. In like manner, near the end of each left-to-right movement of the carriage 24 the clutch member 72 thereof engages the member 76 and provides a further such rotary movement thereof and, through the shaft 34, gears 84 and 86, thereby further advances the record media 30 a like distance past the platen 32 and print heads 28.

As is clear from FIGS. 1 and 2, each of the clutch members pairs 72, 76 and 74, 78 includes mating teeth cut at a precise camming angle so as to provide the above-mentioned extent of angular movement to the shaft 34 during each traversal of the carriage 24 therealong. For purposes of the present embodiment, dimension 96 in FIG. 5 indicates such angle of the engaging surfaces of such teeth and is herein preferred as 35° for efficient clutch member operation and degree of rotary distance desired. In like manner, as illustrated in such FIGS. 1 and 2, and further in FIG. 4, one of the clutch members of each pair thereof is formed with the face of the teeth thereof sloping slightly inwardly from outer to inner peripheral edge thereof — that is, defining a clutch member face surface dishing inwardly in appearance. The reason for such inclined face surface, suffice it to say for the present disclosure, is a quick and simple means in providing necessary clearance for overcoming any possibility of binding effect between clutch member teeth during engagement thereof.

In a typical 5 × 7 matrix character, the carriage 24 would travel back and forth across the machine seven times or make seven passes or cycles to complete a line of characters, near the end of each of which record media advancement takes place as above described. Of course, should the printing of such a character be performed during a single direction of carriage travel only, it is obvious that a single set of mating clutch members 72, 76 or 74, 78 could provide the extent of record material advancement as would be necessary for any given single line of printing — the added requirement being that appropriate carry-over means be provided therewith so as to reset such single set of clutch members for operation during the next return travel of the carriage 24.

It is thus seen that herein shown and described is printing apparatus that utilizes mating toothed members 72, 76 - 74, 78 for advancing the record media 30 in incremental manner past the print station. The apparatus enables the accomplishment of the objects and advantages mentioned above, and while only one embodiment of the invention has been disclosed herein, variations thereof may occur to those skilled in the art. It is contemplated that all such variations, not departing from the spirit and scope of the invention hereof, are to be construed in accordance with the following claims.

What is claimed is:

1. Means for advancing record media past a working station comprising:

support means mounted for rotational movement, carriage means carried by said support means and movable therealong past said working station, first clutch means secured to said carriage means for travel therewith, second clutch means mounted on said support means for rotational movement of said second clutch means in response to engagement by said first clutch means, and means operably associated with said second clutch means for causing incremental movement of said record media upon engagement of said second clutch means by said first clutch means during traversal of said carriage means along said support means.

2. The subject matter of claim 1 including means operably associated with said carriage means for transverse driving thereof.

3. The subject matter of claim 1 including means operably associated with said carriage means for reciprocating driving thereof.

4. The subject matter of claim 1 wherein said means operably associated with said second clutch means comprises gear means and roller means effectively moved at a precise time during traversal of said carriage means.

5. The subject matter of claim 3 wherein said means operably associated with said second clutch means comprises gear means and roller means effectively moved at a precise time at each end of traversal of said carriage means.

6. The subject matter of claim 1 wherein said first clutch means causes rotational movement of said second clutch means during engagement therewith, and wherein said operably associated means includes gear means carried by said second clutch means for causing incremental movement of said record media according to the extent of rotational movement of said second clutch means by said first clutch means.

7. The subject matter of claim 1 wherein said second clutch means is affixed to said support means, said first clutch means causes rotational movement of said second clutch means during engagement therewith, and wherein said operably associated means includes gear means carried by said support means for causing incremental movement of said record media according to the extent of rotational movement of said support means by said second clutch means.

8. The subject matter of claim 1 wherein said second clutch means comprises spaced clutch members secured to said support means, and wherein said first clutch means comprises a clutch member secured at each end of said carriage means for engagement with said spaced clutch members.

9. The subject matter of claim 3 wherein said second clutch means comprises toothed members affixed to said support means, and said first clutch means comprises toothed members on either side of said carriage means and secured thereto and engageable with said support means toothed members for rotation thereof upon traversal of said carriage means in one and the other direction, the teeth of one of said first clutch means toothed members being displaced from the teeth of the other of said first clutch means toothed members for selective driving rotation of said support means toothed members.

10. In a printer having a platen and a print head operable therewith, support means journaled on said printer for rotational movement, and means for advancing record media in a path between said platen and said print head including a print head carriage movable back and forth along said support means, clutch means on said printer and carried on said support means for rotational movement therewith, clutch means on said carriage engageable with said printer clutch means for incremental rotary movement thereof in response to movement of said carriage, and means operably associated with said printer clutch means for causing incremental movement of said record media along said path upon engagement of said printer clutch means by said carriage clutch means.

11. In the printer of claim 10 including camming means operably associated with said carriage for driving thereof.

12. In the printer of claim 10 wherein said carriage clutch means comprises a toothed clutch member at each end thereof engageable with said printer clutch means.

13. In the printer of claim 10 wherein said printer clutch means comprises a toothed clutch member positioned on each side of said carriage and engageable by said carriage clutch means at the ends of travel of said carriage.

14. In the printer of claim 10 wherein said carriage clutch means comprises toothed members secured on each side of the carriage and said printer clutch means comprises toothed members facing the toothed members on each side of the carriage for engagement thereby upon movement of said carriage in one and the other direction.

15. In the printer of claim 14 wherein the teeth of one of said carriage toothed members are displaced less than one pitch length out of phase with respect to the teeth of the other of said carriage toothed members for selectively rotating the toothed members of said printer clutch means at the ends of travel of said carriage.

16. In the printer of claim 10 wherein said means operably associated with said printer clutch means includes gear means secured thereto for rotation thereby, and roller means connected with said gear means for rotation of said roller means.

17. In the printer of claim 10 wherein said means operably associated with said printer clutch means includes a first gear secured thereto and a second gear driven by said first gear, and roller means connected with said second gear for rotation of said roller means.

* * * * *